US012534879B1

(12) United States Patent
Ma et al.

(10) Patent No.: US 12,534,879 B1
(45) Date of Patent: Jan. 27, 2026

(54) HYDRAULIC PUMP WITH DE-STROKE CONTROL

(71) Applicant: Caterpillar Inc., Peoria, IL (US)

(72) Inventors: Pengfei Ma, Naperville, IL (US); Allan S. Thunes, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/783,065

(22) Filed: Jul. 24, 2024

(51) Int. Cl.
*E02F 9/22* (2006.01)

(52) U.S. Cl.
CPC ..... *E02F 9/2225* (2013.01); *E02F 9/2267* (2013.01); *E02F 9/2296* (2013.01)

(58) Field of Classification Search
CPC ..... F15B 11/165; F15B 2211/20553; E02F 9/2296
See application file for complete search history.

(56) References Cited

U.S. PATENT DOCUMENTS 4,801,247 A * 1/1989 Hashimoto ..... F04B 49/06 417/213
5,460,001 A 10/1995 Kato et al.
5,697,764 A * 12/1997 Oda ..... F04B 49/08 60/452
5,884,480 A * 3/1999 Dahl ..... F04B 49/08 60/452
7,204,185 B2 4/2007 Ma et al.
7,341,434 B2 * 3/2008 Belser ..... F15B 11/165 417/218
8,479,504 B2 7/2013 Kerckhove et al.
8,701,396 B2 4/2014 Narotham et al.
9,726,203 B2 * 8/2017 Knapper ..... F15B 11/165
2012/0301325 A1 * 11/2012 Nelson ..... F15B 21/08 417/213
2014/0103233 A1 * 4/2014 Sewcz ..... F04B 1/2042 251/12
2016/0333903 A1 11/2016 Peterson et al.

FOREIGN PATENT DOCUMENTS

JP 2014228101 A 12/2014
KR 100208733 7/1999

OTHER PUBLICATIONS

Written Opinion and International Search Report for Int'l. Patent Appln. No. PCT/US2025/036382, mailed Oct. 6, 2025 (13 pgs).

* cited by examiner

*Primary Examiner* — Abiy Teka
(74) *Attorney, Agent, or Firm* — Schwegman, Lundberg & Woessner

(57) ABSTRACT

A hydraulic pump circuit for a hydraulic system on a work machine may include a variable displacement pump in fluid communication with a hydraulic system via a supply line on a work machine. The variable displacement pump may be configured to provide hydraulic fluid flow to the hydraulic system. The hydraulic pump circuit may also include a stroke actuator in fluid communication with the supply line via a restriction orifice and may be configured for controlling the displacement volume of the variable displacement pump. The hydraulic pump circuit may also include a control valve configured for controlling the stroke actuator to upstroke and de-stroke the pump. The hydraulic pump circuit may also include a cutoff valve arranged and configured to de-stroke the pump when a threshold pressure develops within the hydraulic system.

20 Claims, 4 Drawing Sheets

HYDRAULIC PUMP WITH DE-STROKE CONTROL

TECHNICAL FIELD

The present application relates generally to hydraulic systems such as those used on work machines including heavy equipment for construction, farm implements, and other machines adapted for performing work. More particularly, the present application relates to a particular design of a hydraulic pump for hydraulic systems on work machines.

BACKGROUND

Hydraulic pumps may experience upstroke and destroke when various systems are activated and deactivated. For example, when a hydraulic cylinder within a hydraulic system is extended, fluid may flow to the hydraulic cylinder. For a period of time following activation of the hydraulic cylinder, the fluid pressure in the system may drop until the hydraulic pump can increase the fluid flow to compensate for the new fluid demand. This is often called upstroke of the pump. Similarly, when extension of the hydraulic cylinder is stopped, fluid pressure in the system may increase until the hydraulic pump reduces the fluid flow. This is often called destroke of the pump. Various aspects of the hydraulic system may affect how quickly both upstroke and destroke occur. In some circumstances, destroking a pump too quickly can damage the pump.

Korean Patent 100208733 relates to a hydraulic pressure regulating device. The device may include a first pressure reducing means installed in a main body to reduce pressure of oil supplied from a hydraulic pump. The device may include a second pressure reducing means installed in series with the first pressure reducing means therein to variably adjust the pressure of the oil passing through the first pressure reducing means in accordance with the pressure difference between a front and a rear of the flow path.

SUMMARY

A hydraulic pump circuit for a hydraulic system on a work machine may include a variable displacement pump in fluid communication with a hydraulic system via a supply line on the work machine. The variable displacement pump may be configured to provide hydraulic fluid flow to the hydraulic system. The hydraulic pump circuit may also include a stroke actuator in fluid communication with the supply line via a restriction orifice. The stroke actuator may be configured for controlling the displacement volume of the variable displacement pump. The hydraulic pump circuit may also include a control valve configured for controlling the stroke actuator to upstroke and de-stroke the pump. The hydraulic pump circuit may also include a cutoff valve arranged and configured to de-stroke the pump when a threshold pressure develops within the hydraulic system.

A work machine may include a frame, a traction system for supporting the frame relative to a supporting surface, an engine or motor arranged on the frame and for powering the work machine, an implement for performing work, and a hydraulic system arranged on the work machine and configured to supply hydraulic power to the implement. The hydraulic system may include a hydraulic pump circuit. The hydraulic pump circuit may include a variable displacement pump in fluid communication with a hydraulic system via a supply line on the work machine. The variable displacement pump may be configured to provide hydraulic fluid flow to the hydraulic system. The hydraulic pump circuit may also include a stroke actuator in fluid communication with the supply line via a restriction orifice. The stroke actuator may be configured for controlling the displacement volume of the variable displacement pump. The hydraulic pump circuit may also include a control valve configured for controlling the stroke actuator to upstroke and de-stroke the pump. The hydraulic pump actuator may also include a cutoff valve arranged and configured to de-stroke the pump when a threshold pressure develops within the hydraulic system.

DETAILED DESCRIPTION

Figure 1:
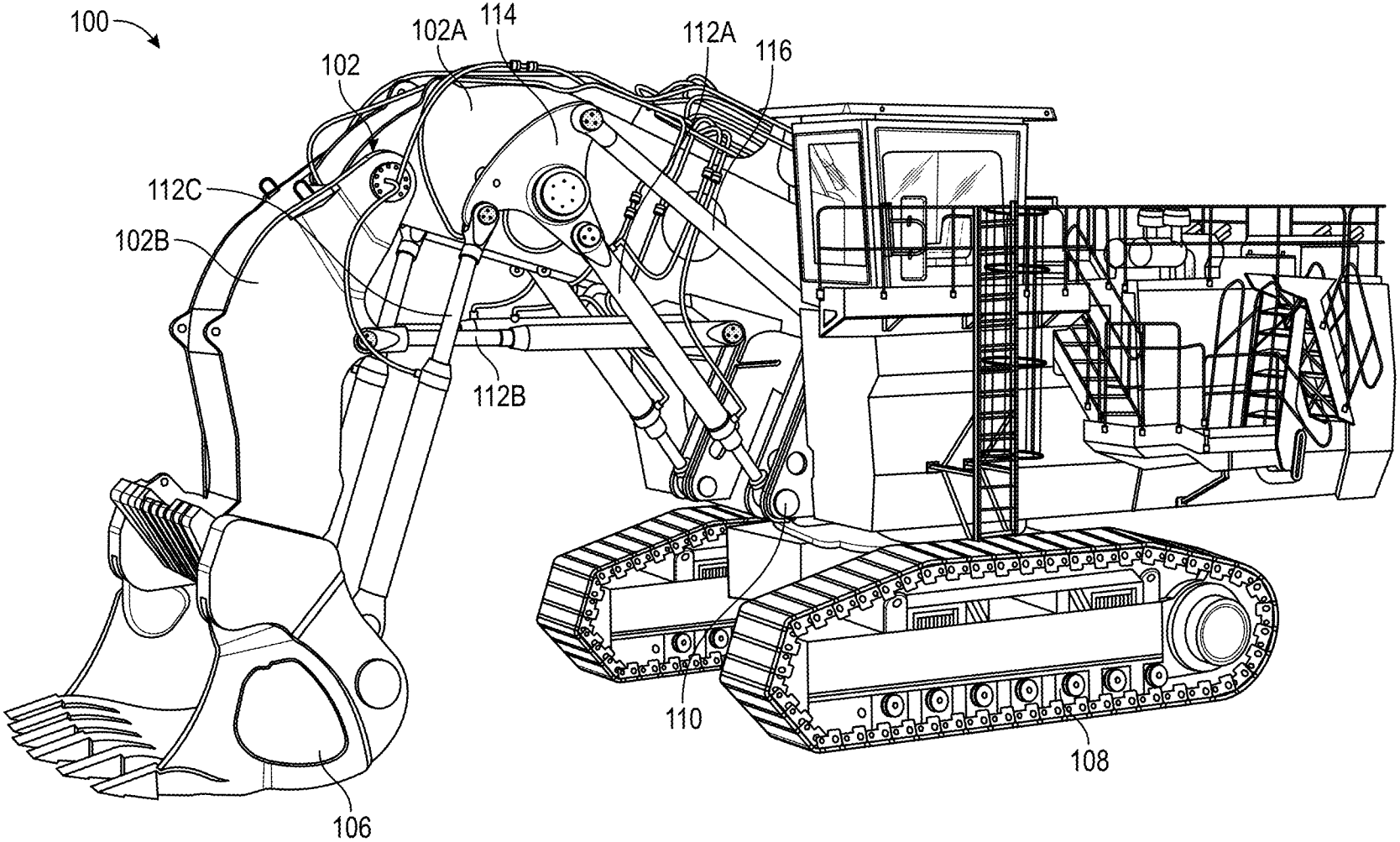
FIG. 1 is a perspective view of a work machine in the form of a hydraulic shovel having a hydraulic pump circuit with de-stroke control, according to one or more examples.

FIG. 1 is a perspective view of a work machine 100. As shown, the work machine 100 may be a hydraulic shovel used in mining operations and may include an implement 102 in the form of a primary or inner boom 102A, a secondary or outer boom 102B, and a tilting shovel 106. The primary and secondary booms 102A/B may be arranged and configured to advance and lift the tilting shovel 106 and the tilting shovel 106 may be arranged and configured on the secondary boom 102B to tilt relative thereto. The implement system 102 may be operable using a hydraulic system. The work machine 100 may include a plurality of ground supporting traction elements 108 (e.g., wheels, tracks, skid feet, etc.) for translating the work machine 100 relative to a supporting surface. The traction elements 108 may be coupled to a frame 110 of the work machine 100 with a suspension system or other framework. The work machine 100 may include an engine or motor 112 to generate power and to drive the traction system 108, the hydraulic system, and other onboard equipment or systems.

In FIG. 1, the booms 102A/B are shown in a lowered position. For example, a pair of primary boom hydraulic cylinders 112A may be in a retracted state and a pair of secondary boom hydraulic cylinders 112B may also be in a retracted state. Yet another pair of booms may include a pair of shovel booms 112C configured to control the tilted position of the shovel 106 relative to the primary and secondary booms 102A/B. In one or more examples, the shovel tilt position may be mechanically controlled by a pair of rotating triangular rockers 114 in conjunction with a pair of steering rods 116. The several hydraulic cylinders may be powered and controlled using a hydraulic system that includes a hydraulic pump. While a particular work machine 100 in the form of a hydraulic shovel 106 has been shown, still other work machines with different types of implements or other working elements may be provided. That is, the hydraulic system and, in particular, the hydraulic pump portion of the hydraulic system described here in may have applicability on a wide range of work machines and nothing herein shall be construed to limit the present description to a hydraulic shovel.

Figure 2:
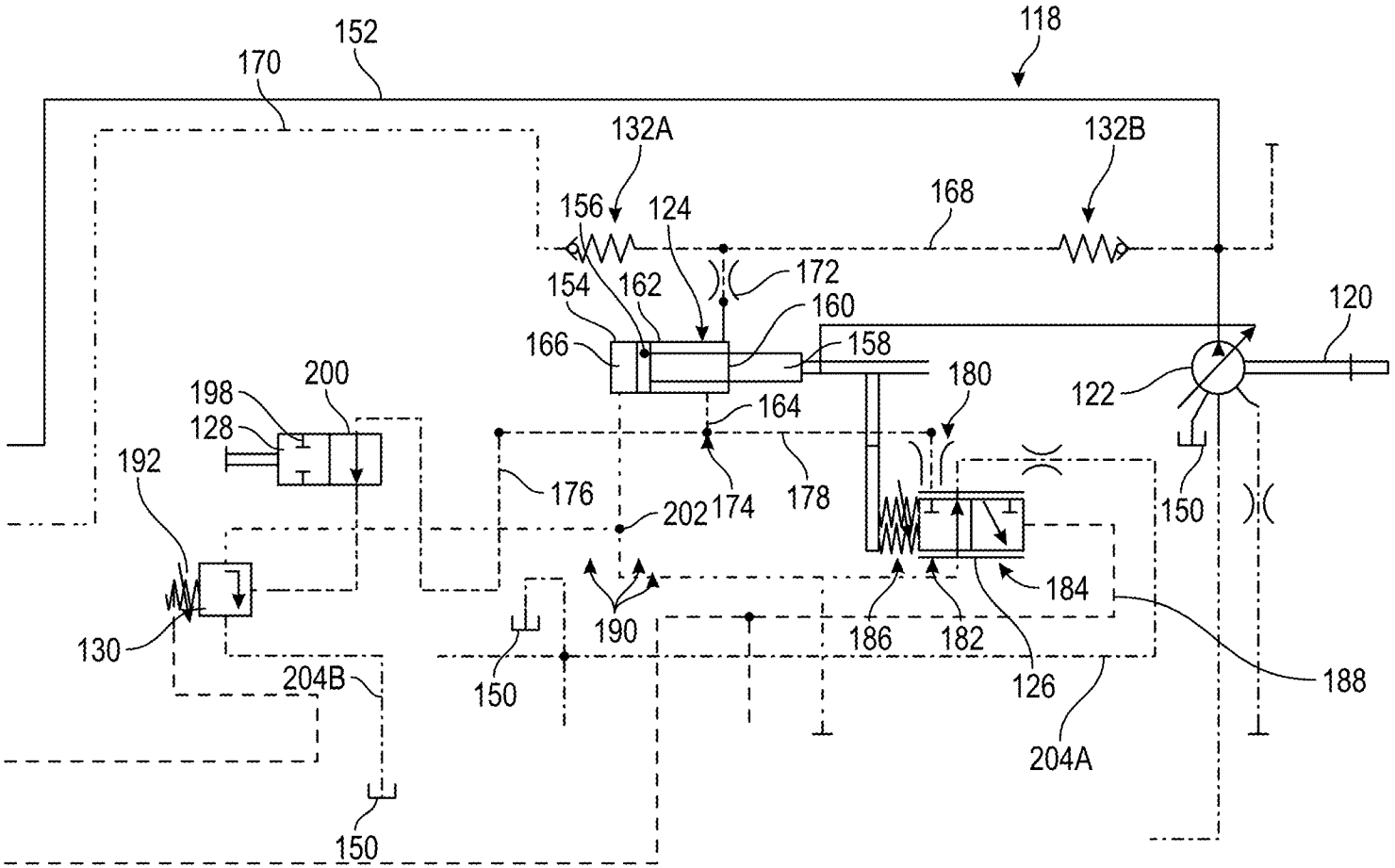
FIG. 2 is a schematic diagram of the hydraulic pump portion of the hydraulic circuit of the work machine of FIG. 1, according to one or more examples.

Referring now to FIG. 2, a schematic diagram of a hydraulic pump portion 118 of a hydraulic circuit is shown. The hydraulic pump portion 118 of the overall hydraulic circuit may be configured to supply flow of hydraulic oil or fluid to the hydraulic system. Several aspects of the hydraulic pump portion 118 may control how much oil or fluid is provided and/or at what rate the oil or fluid is provided, while other aspects of the pump portion 118 of the circuit may limit the pressure deliverable to the hydraulic system. In one or more examples, the hydraulic pump portion 118 of the hydraulic circuit may include a power input portion 120, a pump 122, a stroke actuator 124, a control valve 126, a shutoff valve 128, and a cutoff valve 130. One or more check valves 132A/B may also be provided, and hydraulic lines may interconnect the several components of the system.

The power input portion 120 may be configured to supply the hydraulic pump portion 118 of the circuit with power. In one or more examples, the power may be in the form of rotational shaft power such as at a power take-off location on the engine or motor powering the work machine 100. The pump 122 may be mounted at the power take-off location such that rotational power may be provided to the pump 122. In one or more examples, the pump 122 may be mounted at the power take-off location and, while not shown, additional pumps may be mounted to the pump 122 where rotational power is delivered to the pump 122, which, in turn, delivers rotational power to the additional pumps. Several different arrangements of pumps receiving power from the power take-off location on the engine or motor may be provided.

Figure 3:
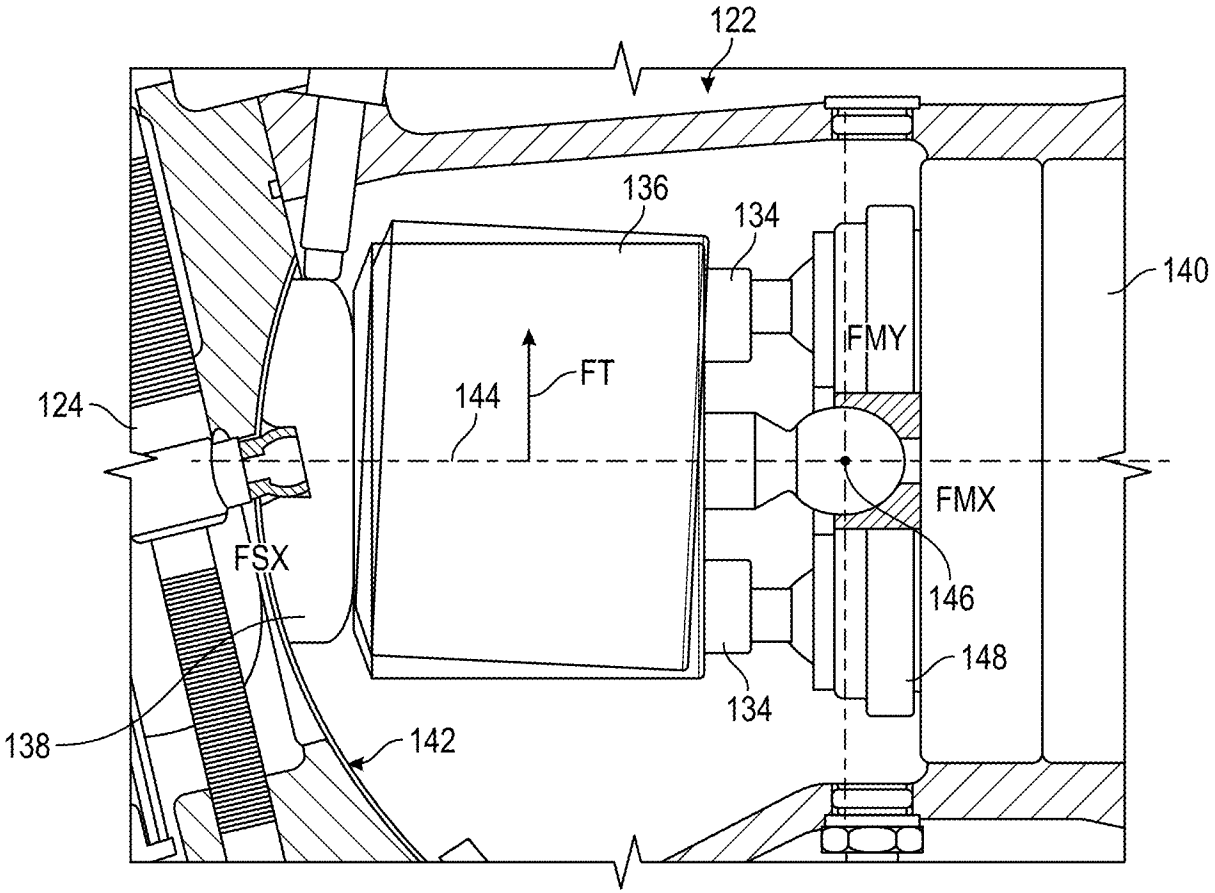
FIG. 3 is a cross-sectional view of a bent axis pump of the hydraulic circuit of FIG. 2, according to one or more examples.

The pump 122 may be configured to supply the overall hydraulic system with flowing fluid or hydraulic oil, for example. In one or more examples, the pump 122 may include a variable displacement pump such as a bent axis pump, an axial piston pump, or another type of pump may be provided. With reference to FIG. 3, a bent axis pump is shown. As shown, the pump 122 may receive rotational power from the power input portion which may rotate a barrel of the pump. That is, the pump may include internal components such as a plurality of cylinder/piston systems 134 arranged within a rotating barrel 136. A lens plate 138 may be provided for adjusting the position of the barrel 136. In the diagram shown, the lens plate 138 is positioned generally centered on the drive shaft 140, but the stroke actuator 124 may be used to adjust the position of the lens plate 138 along a curved inner surface 142 of the pump 122. Adjusting the lens plate 138 along the curved surface 142 may cause the barrel 136 to pivot relative to the longitudinal axis 144 of the drive shaft 140 and about an axis 146 extending generally transverse to the drive shaft 140. The drive shaft 140 may be connected to the barrel 136 and may cause the barrel 136 to rotate about the barrel's longitudinal axis and relative to the lens plate 138. The piston/cylinder systems 134 within the barrel 136 may be operable in series by rotation of the barrel 136. That is, as the barrel 136 rotates, the angled position of the barrel 136 relative to a mounting fixture 148 at the end of the drive shaft 140 may cause the pistons 134 to alternately retract and then extend to draw in fluid through an inlet of the pump 122 and then eject the fluid at an outlet of the pump. As such, adjustment of the lens plate 138 position and, thus, the pivot angle of the barrel 136 may be used to control the amount of displacement provided by the pump 122 and, thus, the amount of fluid being delivered by the pump 122 can be controlled. It is to be appreciated that while a bent axis pump has been shown, an axial piston pump or other variable displacement pump may also be provided. In any case, and with reference back to FIG. 2, the pump may draw fluid from a tank 150 and may deliver fluid through a supply line 152 to the hydraulic system of the work machine 100 to provide hydraulic power to hydraulic cylinders, hydraulic motors, or other hydraulic systems of the work machine 100.

Turning now to the stroke actuator 124, continued reference is made to FIG. 2. As mentioned, the stroke actuator 124 may be configured to control the displacement volume of the pump 122. In particular, and in the case of a bent axis pump, the stroke actuator 124 may be configured to control the position of the lens plate 138 and, thus, the pivot angle of the barrel 136 within the bent axis pump. Where an axial piston pump is provided, the stroke actuator 124 may be used to control the angle of the swash plate, for example. The stroke actuator 124 may be a hydraulic cylinder with a cylinder housing 154, a piston 156 that reciprocates within the cylinder housing 154 and a rod 158 secured to the piston 156 and extending through a rod end 160 of the cylinder housing 154. The rod 158 may be secured to lens plate 138 such that motion of the rod 158 moves the lens plate 138 along the curved surface 142 of the pump 122. As shown, the stroke actuator 124 may include an inlet 162 on a rod-side of the piston 156 as well as an outlet 164 on a rod-side of the piston 156. Still further, the stroke actuator 124 may include an inlet/outlet port 166 on a cap-side of the piston 156.

The stroke actuator 124 may be arranged downstream of the pump 122 along a stroke branch line 168. As shown in FIG. 2, the stroke branch line 168 may branch off of the main hydraulic oil supply line 152 and may extend to an auxiliar pump pressure line 170. A pair of check valves 132A/B may be provided along the stroke branch line 168 and the stroke actuator 124 may be tied into the stroke branch line 168 between the pair of check valves 132A/B. The check valves 132A/B may be biased closed and may be oriented in opposite directions to prevent flow of fluid to the stroke actuator 124 unless the pressure between the check valves 132A/B is lower than the pressure on the other side of either check valve 132A/B. The auxiliary pump pressure line 170 may provide a minimum pressure (e.g., 50 bar) such that when the pump 122 has not reached the minimum pressure, fluid at the minimum pressure will flow to the stroke actuator 124 from the auxiliary pump pressure line 170 and through the auxiliary pump pressure check valve 132A. However, once the pump begins supplying fluid and pressure in the main hydraulic supply line 152 exceeds the minimum pressure, fluid will flow from the main hydraulic supply line 152 into the stroke branch line 168 through the supply side check valve 132B to supply fluid to the stroke actuator 124.

As mentioned, the stroke actuator 124 may be tied into the stroke branch line 168 between the auxiliary pump pressure check valve 132A and the supply side check valve 132B. The connection between the stroke branch line 168 and the inlet 162 of the stroke actuator 124 may include restriction orifice 172. In one or more examples, the restriction orifice 172 may have a diameter or other minimum cross-sectional dimension ranging from approximately 1 mm to approximately 6 mm or from approximately 3 mm to approximately 4 mm, or a diameter or other minimum cross-sectional dimension of approximately 3.5 mm may be provided. This may be in contrast to hydraulic lines or passageways that may range from 8-10 mm, for example. As such, the restriction may reflect a 45% to 90% reduction in diameter or a 50%-70% reduction in diameter or a 60% reduction in diameter may be provided. Due to the relationship between diameter and area, the reduction in area may range from 70% to 99% or from 80% to 90%, or a reduction in area may be approximately 85%. In one or more examples, the restriction orifice 172 may be arranged in a connection line between the stroke branch line 168 and the inlet 162 of the actuator 124. In other examples, the restriction orifice 172 may be built into the inlet 162 of the stroke actuator 124.

With continued reference to FIG. 2, the fluid may exit the rod-side of the stroke actuator 124 via an outlet 164. The outlet 164 may be in fluid communication with a tee or other separation point 174 downstream of the stroke actuator 124. A cutoff branch line 176 may be arranged between the tee 174 and the cutoff valve 130, and a control branch line 178 may be arranged between the tee 174 and the control valve 126. A restriction orifice 180 may be provided between the control branch line 178 and the control valve 126. In one or more examples, the orifice may have a diameter or other minimum cross-sectional dimension ranging from approximately 1 mm to approximately 3 mm or from approximately 1.5 mm to approximately 2.5 mm or an orifice diameter or other minimum cross-sectional dimension of approximately 2 mm may be provided. In one or more examples, the restriction orifice 180 may be arranged in the control branch line 178. In other examples, the restriction orifice may be built into an inlet of the control valve 126.

The control valve 126 may be a two-position valve having a neutral position 182 and an operating position 184. The control valve 126 may be biased toward the neutral position 182 using a spring or other biasing mechanism 186. Opposite the spring or other biasing mechanism 186, the control valve may be coupled to a control pressure line 188 that supplies a control pressure to the valve 126 to counteract the biasing mechanism 186 and, thus, control the valve position. The neutral position 182 may be configured to close off the flow of fluid from the control branch line 178 and to relieve to tank 150 fluid in a stroke control portion 190 of the circuit. In contrast, the operating position may be configured to allow flow of fluid from the control branch line 178 into a stroke control portion 190 of the circuit while closing off the flow of fluid to the tank 150.

As mentioned, the cutoff branch line 176 may be arranged between the tee 174 and the cutoff valve 130. In particular, the cutoff branch line 176 may be connected to the cutoff valve 130 to provide a pilot or operating pressure for the cutoff valve 130. That is, the cutoff valve 130 may be a bypass valve that is biased toward a closed position by a biasing mechanism 192 that acts opposite the pilot pressure. The cutoff valve 130 may open when the pilot pressure provided by the cutoff branch line 176 exceeds a set pressure defined by the biasing mechanism 192. The set pressure of the cutoff valve 130 may range from approximately 25000 kPa to approximately 45000 kPa or from approximately 30000 kPa to approximately 36000 kPa or a cutoff valve set pressure may be approximately 30000 kPA, 33000 kPa, or 36,000 kPa. Still other set pressures may be provided by providing a suitable biasing mechanism 192 or adjusting the biasing mechanism 192 to a suitable or desired pressure.

Figure 4:
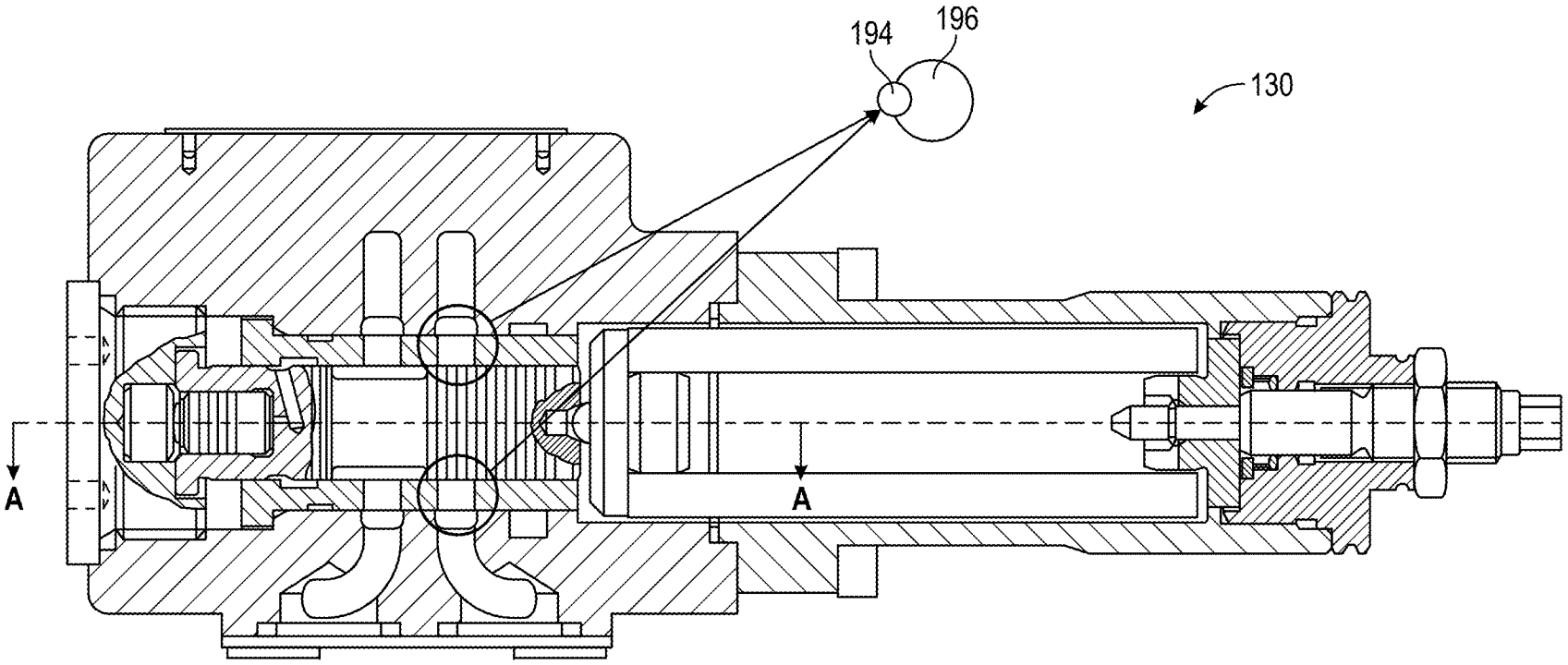
FIG. 4 is cross-sectional view of a cutoff valve of the hydraulic circuit of FIG. 2, according to one or more examples.

Referring to FIG. 4, the cutoff valve 130 may be designed to control the flow through the valve 130 when the valve 130 is actuated. That is, as shown in FIG. 4, a gradually increasing system may be provided where, as the valve opens, the fluid flows through a relatively small opening, orifice, or area 194 before flowing through a larger opening, orifice, or area 196 once the valve 130 is fully open. This gradually increasing system may help to control the rate of flow of the fluid bleeding from the stroke control portion 190 of the circuit when the cutoff valve 130 is actuated. As discussed in more detail below, this can help to control the de-stroke rate of the pump 122. As shown in FIG. 4, the gradually increasing opening or orifice may include an opening where the cross-section of the opening is defined by two overlapping circles with different diameters. In one or more examples, the smaller of the two circles 194 may have a diameter ranging from approximately 1 mm to approximately 3 mm or from approximately 1.5 mm to approximately 2.5 mm or a diameter of approximately 2 mm may be provided. The larger of the two circles 196 may have a diameter ranging from approximately 3 mm to approximately 6 mm or from approximately 3.5 mm to approximately 4.5 mm or a diameter of approximately 4 mm may be provided. While circular openings are shown, other shaped orifices or openings may be provided to establish a gradually increasing orifice or opening size. For example, radiating slots that fan out as they extend and additional slots are added between them may be provided. Moreover, while distinct overlapping shapes (e.g., a circle) have been described as defining the opening shape, a shape without distinct parts may also be provided. For example, a single triangular opening, an oblong or oval opening, or a trapezoidal opening may be provided. In any of the above or other cases and as may be appreciated, as the cutoff valve 130 is triggered by a pilot pressure that overcomes the resisting force of the biasing mechanism 192, the plunger within the cutoff valve may move across the gradually increasing opening 194/196 where the portion of the opening with the smaller area is exposed to fluid flow first and as the plunger moves further, the portion of the opening with larger area is exposed to fluid flow until the full extent of the orifice with the larger area is exposed to the fluid flow.

A shutoff 128 valve may also be provide along cutoff branch line 176. The shutoff valve 128 may be a two-position valve that may be manually controlled. The valve may include a closed position 198 where little to no hydraulic fluid is allowed through the valve 128 and an open position 200 where hydraulic fluid is generally free to flow through the valve 128. The shutoff valve 128 may be helpful for maintenance or other purposes to prevent escape of hydraulic fluid from the system.

As mentioned, a stroke control portion of the circuit may be arranged downstream of the control valve 126 and may be supplied with hydraulic fluid flow when the control valve 126 is in the operating position. The stroke control portion of the circuit may extend from the control valve 126 to the port 166 on the cap side of the stroke actuator 124. In addition, a tee or other separation point 202 may be provided where the stroke control portion of the circuit extends to the cutoff valve 130.

In addition to the stroke branch line 168, the control branch line 178, the cutoff branch line 176, and the stroke control portion 190 of the circuit, one or more bleed lines may also be provided that allow for fluid flow back to a hydraulic tank or reservoir 150. For example, a control bleed line 204A may extend from the control valve 126 to the tank 150. The control bleed 204A line may be coupled to the control valve 126 opposite the stroke control portion 190 of the circuit such that when the control valve is in the neutral position 182, fluid flow is provided from the stroke control portion 190 of the circuit, through the control valve 126 and to the tank 150. However, when the control valve is in the operating position 184, the control bleed line 204A may be closed off. A cutoff bleed line 204B may extend from the cutoff valve 130 to the tank 150. The cutoff bleed line 204B may be coupled to the cutoff valve 130 opposite the stroke control portion 190 of the circuit such that when the cutoff valve 130 opens, fluid flow is provided from the stroke control portion of the circuit 190, through the cutoff valve 130 to the tank 150.

INDUSTRIAL APPLICABILITY

In operation and use, the pump 122 may be driven by the power input from the engine or motor of the work machine 100. As the pump 122 is operated, the amount of fluid flow provided by the pump 122 may be controlled by the stroke actuator 124 in response to calls for hydraulic power. For example, when an operator advances a joystick or other control mechanism to extend a hydraulic cylinder, for example, a control pressure is increased in the control pressure line 188 to shift the control valve 126 from the neutral position 182 to the operating position 184. When this occurs, hydraulic fluid is allowed to flow through the control valve 126 and is directed via the stroke control portion 190 of the hydraulic circuit to the cap side of the stroke actuator 124. Accordingly, the rod-side of the piston 156 in the stroke actuator 124 and the cap side of the piston 156 in the stroke actuator 124 each experience the same pressure that is being produced by the pump 122 and/or the auxiliary pump pressure line, whichever is greater. However, the cap side of the piston 156 may have an area that is larger than the rod-side due to the area taken up by the rod on the rod side. Accordingly, the net force on the piston 156 within the stroke actuator 124 may cause the piston 156 to move to the right. This action may move the rod 158 to the right and may cause the lens plate 138 within the pump 122 to move along the curved internal surface 142 of the pump 122, thus, increasing the displacement volume of the pump 122. This is an upstroke cycle that is responsive to an operator calling for power.

If the operator pulls back on the joystick or otherwise calls for less fluid flow, the pressure in the control pressure line 188 may be decrease, thus, causing the control valve 126 to return to its neutral position 182. This closes off the flow of fluid to the cap side of the stroke actuator 124 and exposes the fluid in the cap side of the stroke actuator 124 to a lower tank pressure. This changes the net force on the piston 156 in the stroke actuator 124 to act to the left causing the piston 156 to move to the left in the schematic and drive the fluid out of the cap side of the stroke actuator 124 and back to the tank 150. Still further, this leftward movement of the piston 156 causes leftward movement of the rod 158, which moves the lens plate 138 of the pump 122 back toward a neutral position along the curved surface 142, thus, decreasing the displacement volume of the pump 122. This is one form of a de-stroke cycle where de-stroke of the pump occurs due to stopping or reducing a call for power.

It is to be appreciated that while full upstroke and de-stroke cycles have been described, the system may manage the call for power and may controllably adjust, switching between upstroke and de-stroke process without completing one or the other. That is, the system may continually move between upstroke and de-stroke cycles mid-cycle depending on the demands for power and/or other factors.

The pump portion of the circuit may also be configured to de-stroke the pump when a pressure developed in the system exceeds a threshold value. For example, if an operator advances a joystick and runs a hydraulic cylinder all the way to its end without letting up on the joystick or if the implement encounters an obstruction or heavy load, or if the pressure in the system otherwise increases to a threshold value, the cutoff valve may be triggered as follows. That is, with call for power, the upstroke cycle may occur as described above. However, when the cylinder stops, when an obstruction is encountered or when a heavy load is encountered, or when other situations arise, pressure in the main hydraulic system may increase which includes the pressure present in the rod end of the stroke actuator 124. As described above, both the control valve 126 and the cutoff valve 130 are in fluid communication with the rod end of the stroke actuator 124. To be clear, the portion of the cutoff valve 130 in communication with the rod end of the stroke actuator 124 is the pilot pressure portion that opposes the biasing force on the cutoff valve 130 which keeps it closed. Accordingly, when the pressure in the system exceeds the biasing force on the cutoff valve 130, the cutoff valve 130 may open. This de-strokes the pump because the stroke control portion 190 of the circuit places the cap end of the stroke actuator 124 in fluid communication with the tank via the cutoff valve 130. With the cutoff valve 130 open, the pump 122 may be quickly de-stroked as the fluid in the cap end flows to tank 150 and the high pressure in the system forces the piston 156 of the stroke actuator 124 to the left.

In some cases, a pump 122 may be de-stroked too quickly, which can cause damage. In the present application the restriction orifice 172 provided upstream of the stroke actuator 124 may limit the rate at which fluid can enter the rod end of the stroke actuator 124. This restriction is particularly useful in the latter described de-stroke scenario because pressures are high and the flow of fluid into the stroke actuator 124 from the stroke branch line 168 can cause an overly fast motion of the stroke actuator 124 to the left causing an overly fast de-stroke of the pump 122. The restriction orifice 172 may limit the rate at which fluid may enter the rod end of the stroke actuator 124 and, as such, may limit the rate at which the pump 122 may be de-stroked. Additionally, and while downstream of the stroke actuator 124, the gradually increasing area of the openings within the cutoff valve 130 may also help to control the de-stroke rate. That is, as discussed with respect to FIG. 4, as the cutoff valve 130 opens, the flow of fluid through the cutoff valve 130 with the gradually increasing openings may be more gradual than a cutoff valve with a single size opening because in the former situation, fluid is allowed to pass through the cutoff valve via the portion of the opening with a smaller area (e.g., 2 mm diameter) at the beginning of the valve opening and only later is allowed to pass through the cutoff valve via the portion of the opening with the larger area (e.g., 4 mm).

The above detailed description is intended to be illustrative, and not restrictive. The scope of the disclosure should, therefore, be determined with references to the appended claims, along with the full scope of equivalents to which such claims are entitled.

What is claimed is:

1. A hydraulic pump circuit for a hydraulic system on a work machine, the hydraulic pump circuit comprising:

a variable displacement pump in fluid communication with a hydraulic system via a supply line on a work machine and configured to provide hydraulic fluid flow to the hydraulic system;

a stroke actuator including a cap side, a rod side, and a piston with a first area facing the cap side and a second area smaller than the first area facing the rod side, the rod side being in fluid communication with the supply line via a restriction orifice and configured for controlling the displacement volume of the variable displacement pump;

a control valve configured for controlling the stroke actuator to upstroke and de-stroke the pump; and a cutoff valve arranged and configured to de-stroke the pump when a threshold pressure develops within the hydraulic system.

2. The hydraulic pump circuit of claim 1, wherein the cutoff valve comprises a gradually increasing system for controlling the flow of fluid through the cutoff valve.

3. The hydraulic pump circuit of claim 1, wherein the rod side of the stroke actuator includes an inlet in fluid communication with the supply line and an outlet in fluid communication with the control valve and the cutoff valve.

4. The hydraulic pump circuit of claim 3, wherein the outlet of the stroke actuator is in fluid communication with a pilot portion of the cutoff valve.

5. The hydraulic pump circuit of claim 1, further comprising a stroke control portion fluidly coupling the control valve to the cap side of the stroke actuator.

6. The hydraulic pump circuit of claim 5, wherein the stroke control portion further fluidly couples the cap side of the stroke actuator with an inlet on the cutoff valve.

7. The hydraulic pump circuit of claim 1, further comprising a stroke branch line arranged between the supply line and the stroke actuator.

8. A hydraulic pump circuit for a hydraulic system on a work machine, the hydraulic pump circuit comprising:

a variable displacement pump in fluid communication with a hydraulic system via a supply line on a work machine and configured to provide hydraulic fluid flow to the hydraulic system;

a stroke actuator in fluid communication with the supply line via a restriction orifice and configured for controlling the displacement volume of the variable displacement pump;

a control valve configured for controlling the stroke actuator to upstroke and de-stroke the pump;

a cutoff valve arranged and configured to de-stroke the pump when a threshold pressure develops within the hydraulic system; and a stroke branch line arranged between the supply line and the stroke actuator wherein the stroke branch line fluidly couples the supply line to an auxiliary pressure supply line via a pair of check valves.

9. The hydraulic pump circuit of claim 8, wherein the stroke actuator is fluidly coupled to the stroke branch line between the pair of check valves.

10. The hydraulic pump circuit of claim 9, wherein the pair of check valves are each biased closed and are configured to open when a pressure outside the stroke branch line exceeds the pressure in the stroke branch line.

11. A work machine, comprising:

a frame;

a traction system for supporting the frame relative to a supporting surface;

an engine or motor arranged on the frame and for powering the work machine;

an implement for performing work; and the hydraulic pump circuit of claim 8.

12. The work machine of claim 11, wherein the stroke actuator is fluidly coupled to the stroke branch line between the pair of check valves.

13. The work machine of claim 12, wherein the pair of check valves are each biased closed and are configured to open when a pressure outside the stroke branch line exceeds the pressure in the stroke branch line.

14. A work machine, comprising:

a frame;

a traction system for supporting the frame relative to a supporting surface;

an engine or motor arranged on the frame and for powering the work machine;

an implement for performing work; and a hydraulic system arranged on the work machine and configured to supply hydraulic power to the implement, the hydraulic system comprising a hydraulic pump circuit, comprising:

a variable displacement pump in fluid communication with a hydraulic system via a supply line on a work machine and configured to provide hydraulic fluid flow to the hydraulic system;

a stroke actuator including a piston with a large area side and a small area side, the small area side being in fluid communication with the supply line via a restriction orifice and configured for controlling the displacement volume of the variable displacement pump;

a control valve configured for controlling the stroke actuator to upstroke and de-stroke the pump; and a cutoff valve arranged and configured to de-stroke the pump when a threshold pressure develops within the hydraulic system.

15. The work machine of claim 14, wherein the cutoff valve comprises a gradually increasing system for controlling the flow of fluid through the cutoff valve.

16. The work machine of claim 14, wherein a rod end of the stroke actuator includes an inlet in fluid communication with the supply line and an outlet in fluid communication with the control valve and the cutoff valve.

17. The work machine of claim 16, wherein the outlet of the stroke actuator is in fluid communication with a pilot portion of the cutoff valve.

18. The work machine of claim 14, further comprising a stroke control portion fluidly coupling the control valve to a cap end of the stroke actuator.

19. The work machine of claim 18, wherein the stroke control portion further fluidly couples the cap end of the stroke actuator with an inlet on the cutoff valve.

20. The work machine of claim 14, further comprising a stroke branch line arranged between the supply line and the stroke actuator.

* * * * *